US009559435B2

(12) United States Patent
Joye

(10) Patent No.: US 9,559,435 B2
(45) **Date of Patent: *Jan. 31, 2017**

(54) SYSTEMS, APPARATUS, AND RELATED METHODS FOR WEATHER-PROOFED WIRE SPLICINGS

(71) Applicant: Michael Joye, Carlsbad, CA (US)

(72) Inventor: Michael Joye, Carlsbad, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 13/966,742

(22) Filed: Aug. 14, 2013

(65) Prior Publication Data

US 2015/0047871 A1 Feb. 19, 2015
US 2016/0372840 A9 Dec. 22, 2016

Related U.S. Application Data

(63) Continuation of application No. 13/198,675, filed on Aug. 4, 2011, now Pat. No. 8,552,296.

(60) Provisional application No. 61/371,970, filed on Aug. 9, 2010.

(51) Int. Cl.

| | |
|---|---|
| ***H01R 13/44*** | (2006.01) |
| ***H01R 4/00*** | (2006.01) |
| ***H01R 4/20*** | (2006.01) |
| ***H01R 4/22*** | (2006.01) |
| ***H01R 4/36*** | (2006.01) |
| ***H01R 13/52*** | (2006.01) |
| ***H01R 43/00*** | (2006.01) |
| *H01R 13/622* | (2006.01) |
| *H01R 13/641* | (2006.01) |

(52) U.S. Cl.

CPC *H01R 4/00* (2013.01); *H01R 4/20* (2013.01); *H01R 4/22* (2013.01); *H01R 4/36* (2013.01); *H01R 13/5216* (2013.01); *H01R 43/005* (2013.01); *H01R 13/622* (2013.01); *H01R 13/641* (2013.01); *Y10T 29/49194* (2015.01); *Y10T 29/49195* (2015.01)

(58) Field of Classification Search

CPC ..... H01R 4/36; H01R 4/22; H01R 4/20; H01R 4/00; H01R 4/56; H01R 4/12; H01R 4/489; H01R 4/4872; H01R 9/11; H01R 11/12; H01R 11/11; H01R 11/28; H01R 13/22; H01R 13/641; H01R 13/622; H01R 13/5205; H01R 13/5216; H01R 43/005; H01R 2201/20; H02G 15/043; Y10T 29/49194; Y10T 29/49195; Y10T 29/49201; Y10T 29/49204

USPC ..... 29/868, 869, 872, 874; 174/87; 403/396; 439/147, 271, 449, 447, 456, 824, 840

See application file for complete search history.

(56) References Cited

U.S. PATENT DOCUMENTS 3,874,760 A * 4/1975 Guthmiller ..... H01R 13/5221 174/91
4,883,921 A * 11/1989 Legerius ..... H01R 4/22 174/84 S
5,047,594 A * 9/1991 Powell ..... H01R 4/70 136/232
5,113,037 A * 5/1992 King et al. ..... 174/87
(Continued)

FOREIGN PATENT DOCUMENTS

CN 2624449 Y * 7/2004

*Primary Examiner* — Timothy Thompson
*Assistant Examiner* — Guillermo Egoavil
(74) *Attorney, Agent, or Firm* — Buche & Associates, P.C.; John K. Buche; Bryce A. Johnson

(57) ABSTRACT

Disclosed are systems, apparatus and related methods for making weather, fire, or water-proofed wire-to-wire electrical connections.

20 Claims, 6 Drawing Sheets

(56) References Cited

U.S. PATENT DOCUMENTS

| | | | | |
|---|---|---|---|---|
| 5,890,929 | A * | 4/1999 | Mills | H01R 13/6599 439/607.03 |
| 5,922,994 | A * | 7/1999 | Robinson, Sr. | H01R 4/22 174/87 |
| 6,198,049 | B1 * | 3/2001 | Korinek | B25B 23/1415 174/87 |
| 2009/0176416 | A1 * | 7/2009 | Flynn | H01R 4/36 439/814 |
| 2010/0048051 | A1 * | 2/2010 | Melni | 439/271 |
| 2012/0034796 | A1 * | 2/2012 | Joye | H01R 4/20 439/147 |

* cited by examiner

SYSTEMS, APPARATUS, AND RELATED METHODS FOR WEATHER-PROOFED WIRE SPLICINGS

CROSS-REFERENCE TO RELATED APPLICATIONS

This application is a continuation of application Ser. No. 13/198,675 filed on Aug. 4, 2011, entitled "Systems, Apparatus, and Related Methods for Weather-proofed Wire Splicings." application Ser. No. 13/198,675 is entitled to the benefit of the filing date of the prior-filed provisional application number 61/371,970 filed on Aug. 9, 2010. These documents are hereby incorporated by reference.

STATEMENT REGARDING FEDERALLY SPONSORED RESEARCH OR DEVELOPMENT

Not applicable.

BACKGROUND OF THE INVENTION

Field of Invention

The present application is in the field of systems, apparatus and related methods for making weather, fire, or water-proofed wire-to-wire electrical connections.

Background of the Invention

Electrical wiring infrastructures are known to have many practical applications in modern societies. Frequently, the assembly of said infrastructures requires electricity conducting ("conductive") wire-to-wire connections. Conductive connections may be accomplished via stripping the insulation off the cores of at least two wires and bringing the exposed cores into contact. Without more, the contacted cores are susceptible to unintended disconnection and pose the risk of shock or spark (i.e., fire) when the connection is live. Furthermore, if the live wire-to-wire connection is exposed to water or weather, then the risk of electric shock increases and, additionally the connected wire cores can be corroded. Accordingly, there is a need for systems, apparatus, and related methods for accomplishing secure (Le., not easily disconnected), electricity insulated ("insulative"), spark resistant, and water/weather-proofed wire-to-wire connections.

Various apparatus and systems have been devised in view of satisfying the above-identified need. For example, U.S. Pat. No. 5,113,037 (issued May 12, 1992) of King et al. and its patent family (hereinafter "the King patents") disclose various embodiments of an apparatus which generally comprise a sealant (e.g., silicon grease or petroleum jelly) filled cap internally featuring tapering female screw-threads. In the King patents, the tapering screw-threads are for gripping and compressing contacted wire-cores; water-proofing and spark resistance is accomplished via the sealant surrounding the contacted wire-cores; and the cap structure insulates the connection. Nevertheless, the King patents have not adequately addressed the above-identified need. One inadequacy, among others, may be that the apparatus disclosed by the King patents does not adequately secure wire-to-wire connections due to the sealant's lubricant properties which counter the gripping function of the tapering female screw threads (i.e., the wire-to-wire connection within the apparatus is susceptible to disassociation from the cap). Therefore, wire connections made according to the King patents remain susceptible to unintended disconnection, shock, spark or wire damage.

Furthermore, apparatus disclosed by the King patents introduce unnecessary limitations into the process of coupling/splicing wires. Continuing the example from above, the King patents' apparatus are limited since: (1) the apparatus and wires are typically small and hard to grip; and (2) the wire-cores must be contacted and aligned throughout the twisting and compression thereof by the tapering female threads. The size and accuracy requirements of the King apparatus necessitate the steadied and practiced hand of a skilled artisan rather than a "do-it-yourself" layman. Furthermore, once the King apparatus has been installed, there is no way to either assure that an electrical connection has been established or to check voltages across the connection, unless the apparatus is removed to reveal sealant covered wire-cores. Removal of the apparatus is messy (i.e., sealant covered), requires re-installation of the apparatus, and is otherwise undesirable. Thus, there remains a need for systems, apparatus, and related methods for accomplishing secure, insulated, spark resistant, and water/weather-proofed wire-to-wire connections that may be practiced by laymen and wherein voltages may be readily measured across the associated wire connections.

Other known apparatus have also been devised to address the above-identified needs, yet these known apparatus have also inadequately addressed said needs or have introduced unnecessary limitations to the wire-coupling process. One type of known, yet inadequate, apparatus features a component (whether conductive or not) that is mechanically anchored to contacted wire-cores and interlockingly coupled to a sealant filled cap. Although these interlocked components provide secure, insulated, and water-proofed wire connections, they also feature limitations, including but not limited to: being hard to grip do to size and accuracy requirements; being hard to assemble; and not providing an easy means for measuring voltage across the connection without disassembly. See e.g., U.S. Pat. No. 6,051,791 (issued Apr. 18, 2000), U.S. Pat. No. 4,039,742 (issued Aug. 2, 1977), U.S. Pat. No. 3,483,310 (issued Dec. 9, 1969), and U.S. Pat. No. 2,870,239 (issued Jan. 20, 1959). Another type of known apparatus features conductive component that is mechanically anchored to a wire-to-wire connection prior to being sheathed with a heat shrink plastic (with or without a sealant filled cap). While said sheathed apparatus provide secure, insulated, and water-proofed wire connections, they too feature limitations, including but not limited to: being hard to grip due to size and accuracy requirements; being hard to assemble; requiring additional tools (e.g., pliers or a blow-torch) that may not be readily available or usable by laymen; and not providing an easy means for measuring voltage across the connection without disassembly. See e.g., Part. No. 270LVC1 sold by Paige Electric (www.paigewire.com). Thus, there remains a need for systems, apparatus, and related methods for accomplishing secure, insulated, spark resistant, and water/weather-proofed wire-to-wire connections that may be practiced by laymen and wherein voltages may be readily measured across the associated wire connections without disassembly.

SUMMARY OF THE INVENTION

It is an object of the present application to disclose systems, apparatus, and related methods for accomplishing secure, insulated, spark resistant, and water/weather-proofed wire-to-wire connections that may be practiced by laymen and wherein voltages may be readily measured across the associated wire connections without disassembly. In one preferable embodiment, the disclosed system may suitably feature: a conductive connector for electrically coupling or splicing any number of wires; and, a sealant filled (e.g., partially sealant filled) cap. Operably, the cap may: first, function as a handle for gripping the connector while the connector is conductively anchored to at least one wire-core; and, second, function as, an insulator which securely retains the connector and coupled wires within the moisture inhibiting sealant. An aperture may be strategically disposed through the cap so that an electrical measuring device (e.g., a volt meter, and ammeter, an ohmmeter, electrometer or the like) may be contacted to a retained connector without compromising the insulative, spark resistant, and weatherproof/waterproof properties of the cap.

It is yet another object of the present application to meet the aforementioned needs without any of the drawbacks associated with apparatus heretofore known for the same purpose. It is yet still a further objective to meet these needs in an efficient and inexpensive manner.

BRIEF DESCRIPTION OF THE FIGURES

The manner in which these objectives and other desirable characteristics can be obtained is better explained in the following description and attached figures in which:

FIG. 30 is a longitudinal cross section of FIG. 3A.

It is to be noted, however, that the appended figures illustrate only typical embodiments disclosed in this application, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general, the disclosed system may suitably feature: a conductive connector for electrically coupling/splicing any number of wires; and, a sealant filled (e.g., partially sealant filled) cap. Operably, the cap may: first, function as a handle for gripping the connector while the connector is conductively anchored to at least one wire-core; and, second function as an insulator which securely retains the connector and coupled wires within the moisture inhibiting sealant. An aperture may be strategically disposed through the cap so that an electrical measuring device may be contacted to a retained connector without compromising the insulative, spark resistant, and weatherproof/waterproof properties of the cap.

Figure 1A:
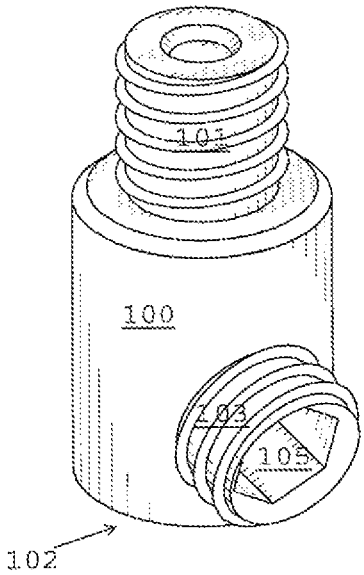
FIG. 1A is a perspective view of a preferable embodiment of a conductive and male headed connecter.
Figure 1B:
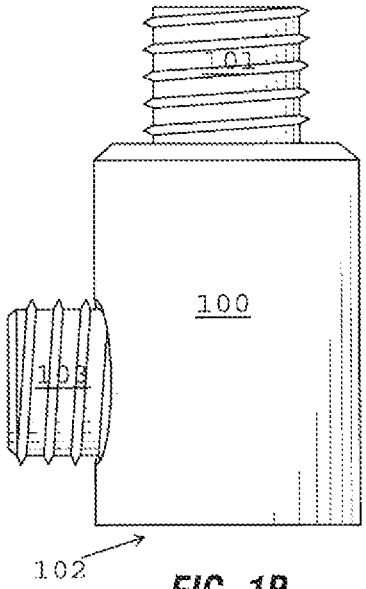
FIG. 1B is a side view of the connector of FIG. 1A.
Figure 1C:
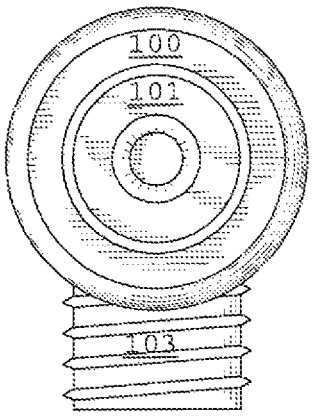
FIG. 1C is a top view of the connector of FIG. 1A.
Figure 1D:
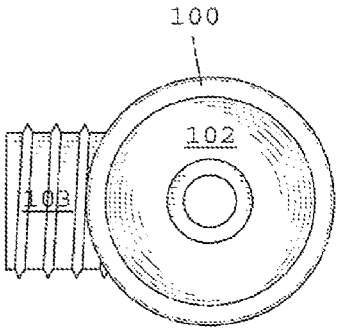
FIG. 1D is a bottom view of the connector of FIG. 1A.
Figure 1E:
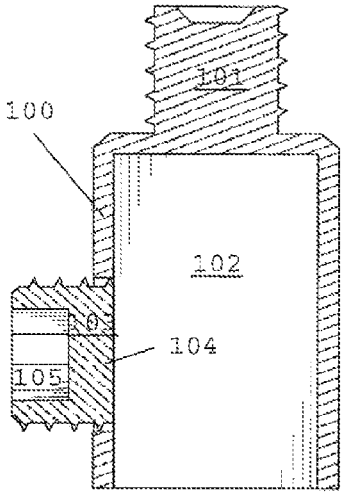
FIG. 1E is a longitudinal cross-section of the connector of FIG. 1A.

FIG. 1A is a perspective view of a preferable embodiment of an electricity conducting ("conductive") connector 100. As seen in the figure, the connector 100 suitably features a head 101, a wire-receptacle 102, and a set screw 103. FIGS. 1B through 1D respectively depict a side, the top, and the bottom views of the connector 100 depicted in FIG. 1A. FIG. 1E depicts a longitudinal cross-section of the connector 100 of FIGS, 1A through 1D. Taken together, FIGS. 1A through 1E suitably illustrate the above referenced components of the depicted connector 100.

The head 101 is best illustrated in FIGS. 1A, 1B and 1C. Referring to these figures, the head 101 is an input for the secured placement of the connector 100 at a cooperating socket. As discussed in greater detail below, the head 101 and a cooperating socket may suitably be the primary mechanism for removably securing the connector 100 to an object (see, e.g. FIGS. 5A through 5C wherein the connector 100 is removable secured to a cap 400 via cooperating head 101 and sockets 403, 404). In a preferred embodiment, the head 101 may be threaded in the manner of a male-screw or bolt. Manners of threading the screw-head 101 will be well known to those of skill in the art and include, but are not limited to thread cutting (e.g. threading via taps and dies, single-point threading, or thread milling including form-milling and thrilling) and thread forming and roving, thread casting or molding, thread grinding, and thread lapping. Although depicted with male threads, the head 101 may feature any mechanism for removable, yet secure, input to a socket. Such mechanisms are known or apparent to those of skill in the art and may include, without limitation: snap fasteners; restriction fittings; and the like.

The wire receptacle 102 and set screw 103 are best seen in FIGS. 1A, 1D, and 1E. Referring to these figures, the wire receptacle 102 defines a cavity within the connector 100 that is configured to receive the stripped core of at least one, but preferably two or more, wires. Referring specifically to FIG. 1E, the set-screw 103 features a point 104 and a head 105 and is threadedly disposed through a side of the connector 100 so that the point 104 is within the cavity 102 while the head 105 may be accessible outside of the connector 100. Operably, the wire-receptacle 102 may suitably receive any number of stripped wire cores so that: (1) the point 104 of the set screw 103 may be driven in the manner (i.e., drive style) of a screw through the connector 100 side into compressive or clamping contact with the stripped wire cores, wherein the wire cores electrically contact each other and/or the connector 100; and (2) so that the wires' relative motion with respect to the connector 100 is prevented or otherwise restricted (i.e., the wires are not easily disengaged from each other and/or the wire-receptacle 102). The geometry of the set point 104 may vary and acceptable geometries will be well known to one of skill in the art. Such known geometries may include, but should not be limited to: Flat Point; Domed Point; Cone Point; Cup Point; Knurled Cup Point; Extended Point (Pilot Point, Dog Point): and the like, The geometry of the set screw head 105 may be blind and may also vary according to available or preferable drive styles which will be known to those of skill in the art. Said geometries and drive-styles may include, but should not be limited to: Hex, Allen, slot, Torx, star, Phillips, Bristol Spline, and the like.

Preferably, the connector 100 and its components are constructed of electricity conducting materials so that stripped wire cores installed within the wire-receptacle 102 may be electrically coupled via contact with the connector 100 in lieu of, or in addition to, core-to-core contact. Metals are preferable materials for constructing the connector 100 since metals are typically conductive and susceptible to machining, molding, and being cut or manipulated. Silver, Gold, Copper, Aluminum, and Brass are the most preferable metals for constructing the connector 100. Yet still, other conductive materials known to one of skill in the art are also be preferable for constructing the connector 100, and may include without limitation graphite and other non-metallic electrical conductors.

Figure 2A:
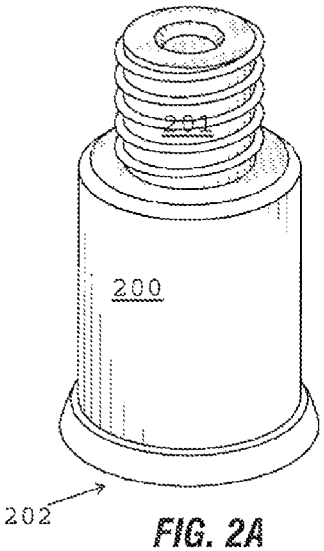
FIG. 2A is a perspective view of an alternate yet still preferable embodiment of a conductive male headed connector.
Figure 2B:
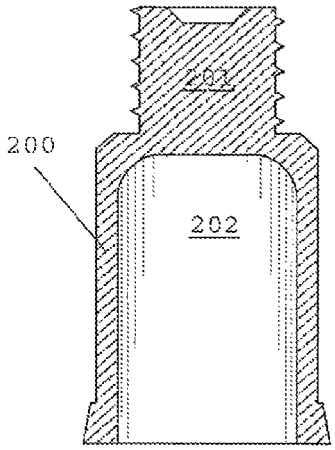
FIG. 2B is a longitudinal cross-section of the connector of FIG. 2A.

FIGS. 2A and 26 respectively illustrate perspective and cross-section views of an alternate embodiment of a connector 200. As with the connector 100 depicted in the earlier figures, the connector 200 of FIGS. 2A and 2B features a head 201 and a wire-receptacle 102. As with the earlier embodiment, the head 201 defines an input for a cooperating socket and may be a male-threaded screw or bolt. The wire-receptacle 202 defines a cavity within the connector 200 that is configured to receive the stripped core of at least one, but preferably two or more, wires. However, unlike the earlier embodiments, the connector 200 of FIGS. 2A and 2B does not feature a set screw for retaining electrically coupled wire cores within the connector 200. Instead, the connector 200 is preferably constructed of electrically conductive and malleable material whereby the body of the connector 200 may be crimped around the installed wire-cores. Examples of suitable manners of crimping are disclosed in U.S. Pat. No. 2,870,239 (issued Jun. 10, 1959) and U.S. Pat. No. 3,483,310 (issued Dec. 9, 1969) but other modes or crimp styles will be known or readily apparent to one of skill in the art. It should be noted, however, that regardless of the crimp style employed for retaining and electrically coupling stripped wire cores within the wire-receptacle, the resultant deformation of the connector 200 body should preferably not affect the operability of the head 201. As with the earlier embodiment, metals including silver, gold, copper, aluminum, and brass, may be used to construct the connector 200 with the walls of the connector 200 preferably being made thin so that the connector 200 is malleable and crimping is possible. In all other respects the connector 200 may be constructed and operated in the manner of the connector 100 disclosed in FIGS. 1A through 1E.

Figure 3A:
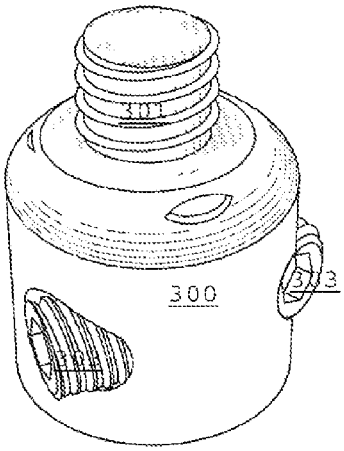
FIG. 3A is a perspective view of another alternate yet still preferable embodiment of a conductive male headed connector.
Figure 3B:
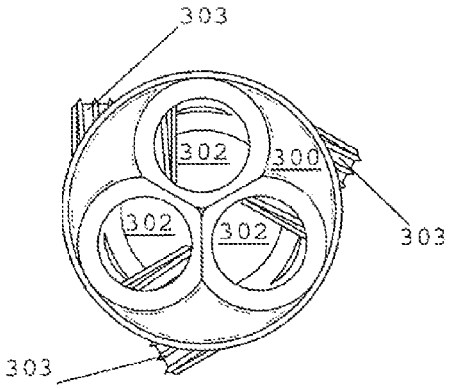
FIG. 3B is a bottom view of the connector of FIG. 3A.
Figure 3C:
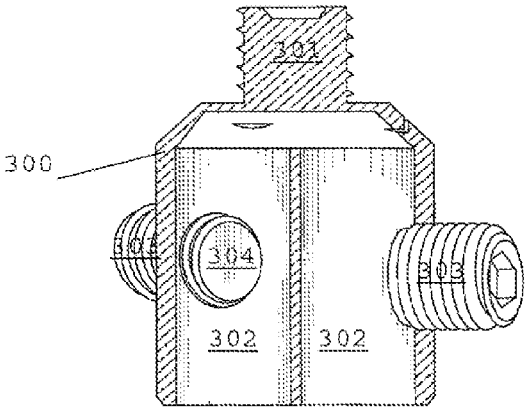

FIGS. 3A, 38, and 30 respectively illustrate perspective, bottom, and cross-section views of another alternate yet preferable embodiment of a conductive connector 300. As with the other connectors 100, 200 disclosed above, the connector 300 features a head 301. Unlike the earlier embodiments, the connector 300 suitably features one or more wire-receptacle 302 so that sets of stripped wire cores may be electrically coupled within each wire-receptacle 302 or so that multiple large-gauge wires may be electrically coupled via the connector 300 (e.g., one stripped core installed per receptacle 302). In all other respects the connector 300 operates in the manner of the connector 100, 200 disclosed in the earlier figures. It should also be noted that, even though FIGS. 3A through 30 depicted the connector 300 with set screws for securing and electrically coupling the wires to each other and/or the connector 300, the connector 300 may also be constructed so that a crimping connection could be made as disclosed in connection with FIGS. 2A and 2B.

Although the connectors 100, 200, 300 are depicted with various means and mechanisms (e.g., set screw and crimp) for retaining stripped wires within the wire-receptacles 102, 202, 302, other means and mechanisms for retaining stripped wire cores within the wire receptacle will be known or apparent to one of skill in the art and may include without limitation female-threaded wire-receptacles (see e.g., U.S. Pat. No. 5,113,037 (issued May 12, 1992), soldering, tying (see e.g., U.S. Pat. No. 6,051,791 (issued Apr. 13, 2000), twisting, wedging (see e.g., U.S. Pat. No. 6,051,791, FIG. 2) and the like. Said known or apparent wire-retaining means and mechanisms, including others, may be employed without departing from the spirit and intent of this application. In addition, although depicted with a general cylindrical shape, a connector 100, 200, 300, may be of any shape or cross section, as long as it features a head and a wire receptacle.

Figure 4A:
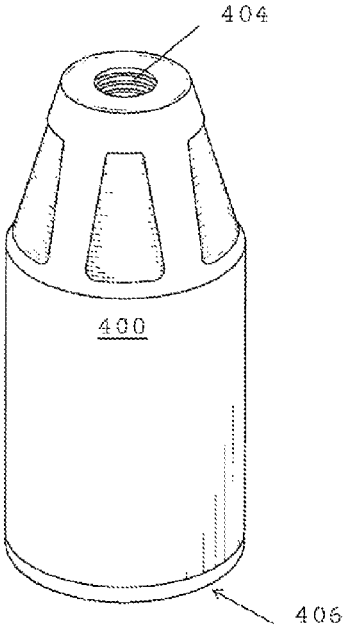
FIG. 4A is a perspective view of a preferable embodiment for a cap.
Figure 4B:
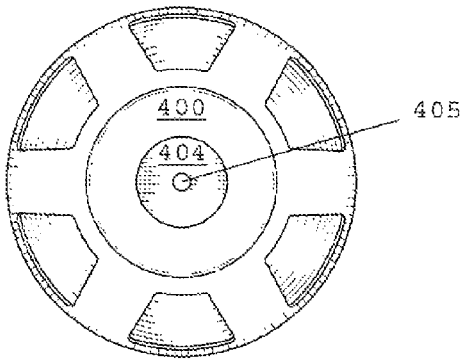
FIG. 4B is a top view of the cap of FIG. 4A.
Figure 4C:
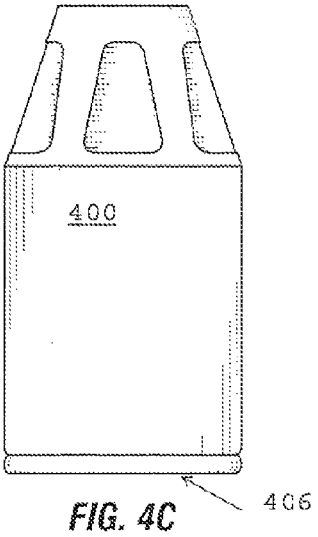
FIG. 4C is a side view of the cap of FIG. 4A.
Figure 4D:
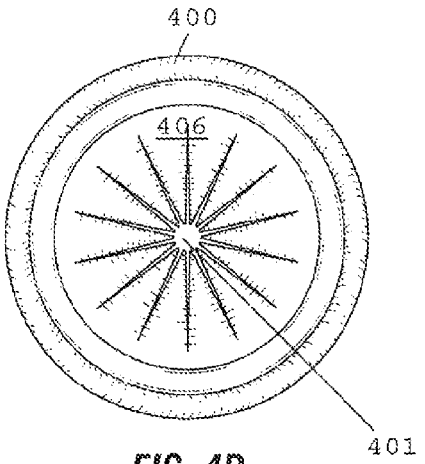
FIG. 4D is a bottom view of the cap of FIG. 4A
Figure 4E:
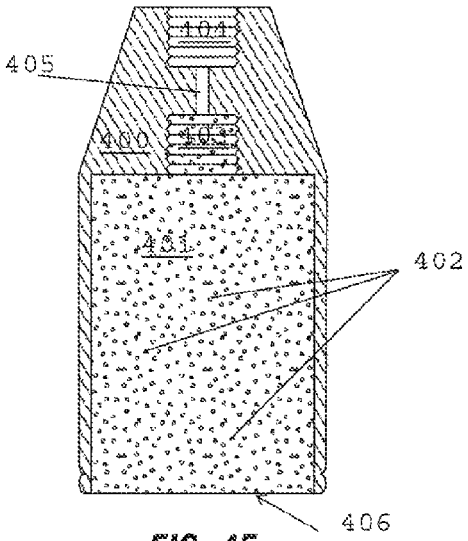
FIG. 4E is a longitudinal cross-section of the cap of FIG. 4A.

FIG. 4A is a perspective view of a preferable embodiment of an electricity insulating ("insulative") cap 400. As seen in the figure, the cap 400 is generally cylindrical in shape with one side tapering to a point occupied by an external socket 404. FIGS. 4B through 4D respectively depict the top, a side, and the bottom views of the cap 400 depicted in FIG. 4A, FIG. 4E depicts a longitudinal cross-section of the cap 400 of FIGS. 4A through 4D. As seen in its cross-section, the cap 400 is hollow and internally features a sealant receptacle 401, an internal socket 403, closure 406, and a probe-port 405. Taken together, FIGS. 1A through 1E suitably illustrate the above referenced components of the depicted cap 400.

The sealant receptacle 401 is best depicted by FIG. 4E. As seen in the figure, the sealant receptacle 401 generally defines the hollow of the cap 400. Operably, the sealant receptacle 401 is adapted to receive and retain a viscous sealant 402 with moisture inhibiting properties. Viscous sealants are known or will be apparent to those of skill in the art and may include, without being limited to: a silicone based material or the like, including silicone grease; potting compound; greases; adhesives, mastics, gels, or any other waterproofing and/or fire retardant compounds. The sealant 402 is preferably viscous so that it remains within the sealant receptacle 401 of the cap 400 during periods of cap 400 storage or use due to its inherent non-flowability. Preferable sealants can include Silicone Grease, Petroleum jelly, or Amorphous Calcium Carbonate. Sealant may be provided to the sealant receptacle at any time.

The inner socket 403 is best depicted in FIG. 4E. As seen in the figure, the inner socket is within the cap 400 and integral with the sealant receptacle 401. Preferably, the internal socket 403 defines a means for removably, yet securely, retaining an input (see, e.g. FIGS. 5B and 50 wherein the internal socket receives the head 101 of a connector 100 as an input). The socket 403 is depicted in FIG. 4E with female-threads for cooperating with the male threads of an input so that the input is securely and removably retained by the socket 403. Although depicted with female threads, the inner socket 403 may feature any mechanism for removably, yet securely, retaining an input. Such mechanisms are known or apparent to those of skill in the art and may include without limitation, snap fasteners, restriction fittings, and the like.

The outer socket 404 is best depicted in FIG. 4A, 4B, and 4E. As seen in the figures, the socket 404 is suitably disposed externally and opposite to the inner socket 403. The inner 403 and outer 404 sockets are preferably adapted to retain the same inputs, the only difference between the sockets suitably being their position on the cap 400. Although depicted with female threads, the external socket 404 may feature any mechanism for removably, yet securely, retaining an input. Such mechanisms are known or apparent to those of skill in the art and may include without limitation, snap fasteners, restriction fittings, and the like.

The probe-port 405 is best depicted in FIGS. 4B and 4E. As illustrated by the recited figures, the probe-port 405 is preferably a hole through the cap 400 wall for access to the sealant receptacle 401 and for suitably allowing probes to interact with items retained within the cap. For reasons discussed in greater detail below, the probe-port is preferably positioned in the cap 400 so that a probe inserted therethrough enters the sealant receptacle 401 at the inner socket 403.

The closure 406 is best seen in FIGS. 4C and 4E. The cap closure 406 is preferably a means for elective closing of the sealant receptacle 401. As shown in FIGS. 4C and 4E, the closure 406 occupies the open end of the cap 400 and is preferably defined by a plurality of triangular segments which converge at their points and which suitably yield or flex away from said convergence in response to a normal force. Suitably, when the segments converge, the closure 406 closes the cap 400 (more specifically, the sealant receptacle 401 of the cap 400). However, when the segments flex or yield, the cap 400 is open so that items may be deposited therein the cap's 400 sealant receptacle 401. Notably, items such as wire couplings/splicings may be deposited into the cap 400 through the closure 406 while the wire remnants extended through the closure 406 since the segments suitably flex around, and conform to, said wire remnants (see, e.g., FIG. 5C). Additionally, the closure 406 may check the flow of sealant 402 retained within the sealant receptacle 401 to inhibit its leakage therefrom. Other features and preferable aspects of such a closure are known and disclosed in U.S. Pat. No. 5,113,037 (issued May 12, 1992) and U.S. Pat. No. 6,051,791 (issued Apr. 18, 2000). It should be noted that other suitable cap closures are known or will be apparent to one of skill in the art.

Preferably the cap 400 defines an electrical insulator (i.e., electrically-non-conductive) because, as discussed in greater detail below, the connection of coupled or spliced electrical wires may be retained therein without passing electricity through the cap structure (except, suitably, through any said coupled or spliced wires). Suitable materials for constructing the cap 400 may, therefore, be glass, porcelain, Teflon, composite polymers, rubber-like polymers, wood, and other like insulative materials. A preferable material for cap construction is Nylon or polypropylene. A preferable material for the closure 406 is rubber and rubber-like polymers. Depending on the material, the cap 400 body may be constructed, molded, or machined as multiple pieces or a single piece. In one embodiment the cap 400 body and the closure 406 are molded/machined/constructed separately, and the closure 406 installed on the cap in the manner of U.S. Pat. No. 5,113,037 (issued May 12, 1992) and U.S. Pat. No. 6,051,791 (issued Apr. 18, 2000) or any other known manner.

In general, a system comprising a cap 400 and a connector 100 200, or 300 may suitably be used for spark resisting, weather proofing, and/or water-proofing at least one wire-splice or electrical wire coupling. First, a conductor 100, 200, 300 may be handled via inputting its head 101, 201, 301 into the external socket 404 of a cap 400, In a preferable embodiment, the head 101, 201, 301 is screwed into the socket 404 via the cooperation of male and female threads. Second, the stripped cores of any number of wires may be secured to within the wire-receptacle 102, 202, 302 of a connector 100, 200, 300 (via set screw 103, 303, or crimping) so that the wires are electrically coupled by contact with each other and/or the connector 100, 200, 300. Third, the connector 100, 200, 300, including any retained wire-cores, may be passed into the cap 400 through the closure 406. Finally the connector 100, 200, 300 may be deposited into the cap 400, wherein the head 101, 201, 301 inputs to the inner socket 403 to removably, yet securely, retain the connector 100, 200, 300 within the sealant receptacle 401. Suitably, the sealant receptacle 401 features an amount of sealant 402 so that the connector 100, 200, 300 and coupled wires are preferably surrounded by the sealant 400 whereby moisture is inhibited from reaching the electrical connection(s) (i.e., the wire coupling(s) within the cap 400). The more specific aspects of this system and related methods are best disclosed in reference to FIGS. 5A through 5C.

Figure 5A:
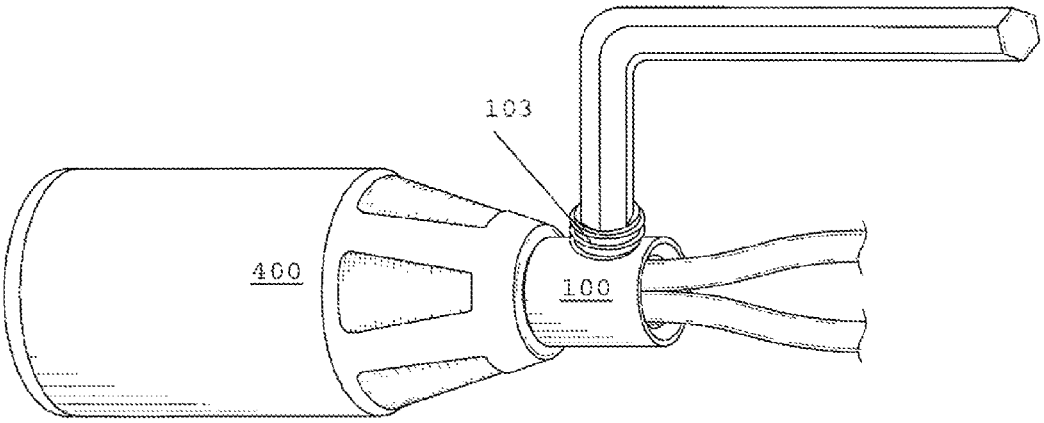
FIG. 5A is a contextual view of the cap of FIG. 4A and connector of FIG. 1A.

FIG. 5A is a contextual view of the initial steps in a preferable wire splicing/coupling procedure contemplated by the disclosed system. As alluded to above, the connector 100 may be used to electrically couple wires by anchoring stripped wire cores to within the wire-receptacle 102 via pressure from the set-screw 103. To assist a user in, among other things, (1) gripping the connector 100, (2) directing the connector 100 to coupling contact with stripped wire cores, and (3) practicing the crimp or drive-style of the connector 100, 200, 300, the cap 400 may removably receive the head 101 of the connector 100 in its external socket 404 so that the cap 400 functions as a handle to the connector 100. Such cap 400 operability is particularly useful when the wires and connector 100 are tiny relative to a human hand because less skill (hand-coordination) is required to install the connector 100, when featuring a handle, since the connector 100 is easier to grip, guide, and manipulate. Notably, the drive style required for depressing the set screw 103 into contact with wire cores provided to the wire receptacle 102 is preferably more easily implemented whenever the cap 400 is used as a handle for gripping the connector 100. In the depicted embodiment, the connector 100 is received at the socket 404 via rotatable cooperation of the male threads of the head 100 and the female threads of the socket 401. After a wire splice/coupling is made, the connector 100 may be disengaged from the socket 404 of the cap 400.

Figure 5B:
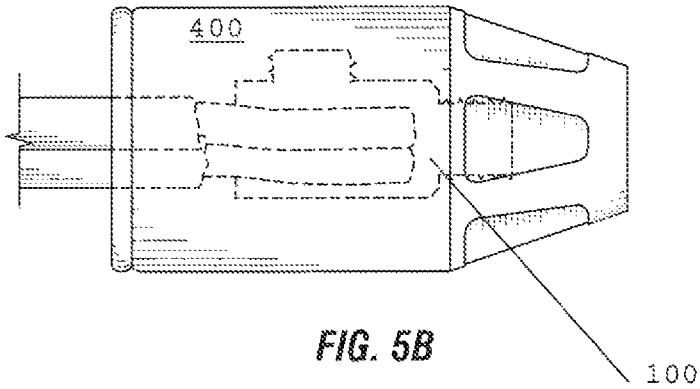
FIG. 5B is another contextual view of the cap of FIG. 4A and the connector of FIG. 1A.
Figure 5C:
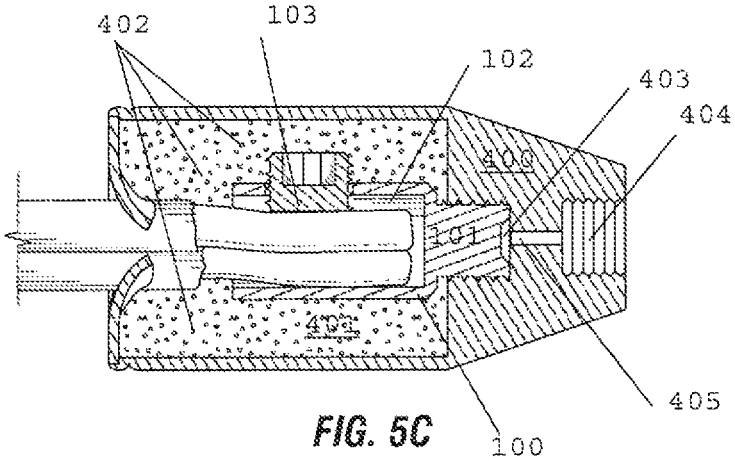
FIG. 5C is a cross section of the cap of FIG. 4A and connector of FIG. 1A as such are contextually depicted in FIG. 5B.

FIG. 5B and 5C illustrate the insulating, spark resistance, and waterproofing mechanisms of the cap 400. More specifically, said figures are respectively a side view and cross-section of a wire-splicing connector 100 being waterproofingly retained within the cap 400. Wires that are electrically coupled via a connector 100 may be passed through the closure 406 of the cap 400 (which cap 400, in the preferred embodiment, was formerly employed as a handle for wire installation as disclosed above) so that the wire coupling may be surrounded by a sealant 402 contained within the sealant receptacle 401 of the cap 400. As mentioned above, sealant surrounding the coupling suitably prevents or inhibits moisture from contacting the coupling. Also mentioned above, the structure of the cap is comprised of material that does not readily conduct electricity whereby the cap insulates the electrical connection of the wires. While within the sealant receptacle 401, the wire coupling may be removably, yet securely retained therein via inputting the head 101 into the internal socket 403.

Figure 6:
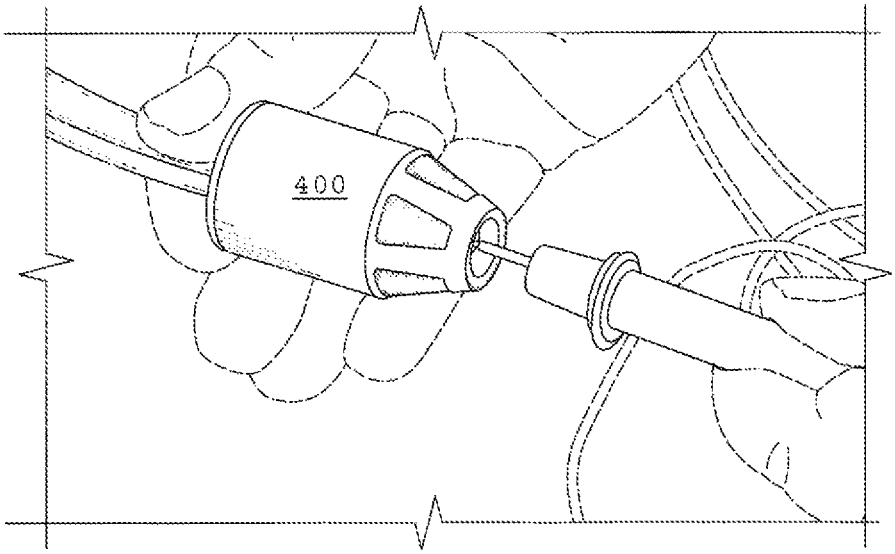
FIG. 6 is yet another contextual view of the cap of FIG. 4A and connector of FIG. 1A.

FIGS. 5C and 6 illustrates the manner by which a wire-to-wire connection employing the disclosed system may be accessed by an electrical measuring device without disassembling the system or compromising its insulative, spark resistive, and water/weather proofing properties. As seen in the figures, the probe of an electrical measuring device may be guided through the aperture 405 into conductive contact with the head 101 of the connector 100. The connector 100, being composed of conductive material, can electrically communicate to the contacted probe whereby the electrical properties of the connection can be ascertained at any point in the lifetime of the connection without removing the connector 100 from the cap 400.

It should be noted that FIGS. 1 through 7 and the associated description are of illustrative importance only. In other words, the depiction and descriptions of the present invention should not be construed as limiting of the subject matter in this application. For example, the system may be designed with dimension for coupling/splicing wires of any guage or electrical capacity without departing from the spirit and intent of this disclosure. For another example, the male and female characteristics of the connector heads and cap sockets may be swapped whereby the connector features a socket while the cap features internal and external heads. Additional modifications may become apparent to one skilled in the art after reading this disclosure.

In summary, what is disclosed may be a connector with a head and wire receptacle. What is further disclosed may be a sealant-filled cap with internal and external sockets for receiving the head of a connector. What is also further disclosed may be system for coupling wires comprising (1) a connector with a head and wire receptacle, and (2) a sealant-filled cap with an internal and external socket for receiving the head of said connector. Yet still, what may be disclosed is a method of coupling wires comprising the steps of (1) securing the head of a connector with a sealant-filled cap so that the cap functions as a handle for the connector, (2) anchoring the wires to said connector, (3) unsecuring the connector plus wires from the cap, (4) depositing the connector plus wires into the cap so that the connector plus wires is surrounded by the sealant. Also disclosed may be a method for placing sealant around a wire connection comprising the steps of (1) securing the head of a connector with sealant filled cap so that the cap functions as a handle for the connector, (2) anchoring the wires to said connector, (3) unsecuring the connector plus wires from the cap, (4) depositing the connector plus wires into the cap so that the connector plus wires is surrounded by the sealant. Other things may be disclosed which are not specifically summarized above.

I claim:

1. A system for coupling wires comprising:
- a conductive connector for splicing two or more wires featuring:
  - a head; and
- a cap comprising:
  - a hollow body;
  - a first socket, located on the inside of the hollow body;
  - a second socket, located on the outside of the hollow body;
  - wherein the head is configured for removable input to the second socket so that the connector is releasably secured to the outside of the hollow body of the cap whenever the head is input into the second socket;
  - wherein the head is configured for removable input to the first socket so that the connector is securable to the inside of the hollow body of the cap whenever the head is input into the first socket; and
  - wherein said sockets are configured to receive and releasably retain the head of the connector.

2. The system of claim 1 wherein said connector features at least one wire receptacle.

3. The system of claim 2 wherein said connector features a means for anchoring a wire within said wire receptacle(s).

4. The system of claim 1 wherein the hollow body is filled with sealant.

5. The system of claim 4 wherein the body further comprises a probe-port.

6. The system of claim 5 wherein the hollow body features an open end.

7. The system of claim 6 wherein the open end of the hollow body features a closure.

8. The system of claim 7 wherein the wire receptacle recevies the stripped core of at least one wire.

9. The system of claim 8 wherein the cap has one side tapering to a point occupied by an external socket.

10. The system of claim 9 that is defined by a cap closure.

11. The system of claim 10 wherein the cap closure is defined by a plurality of triangular segments.

12. The system of claim 11 wherein the triangular segments converge and flex away from the convergence.

13. The system of claim 12 wherein the connector side receives the set screw into compressive contact with the stripped wire cores.

14. The system of claim 12 wherein the connector side receives the set screw into clamping contact with the stripped wire cores.

15. The system of claim 12 wherein the connector is constructed of electrically conductive and malleable material,
- wherein the connector is crimped around the installed wire cores.

16. The system of claim 12 wherein the stripped wire cores are electrically coupled within each wire-receptacle.

17. The system of claim 12 wherein multiple wires are electrically coupled via the connector.

18. The system of claim 12 wherein the cap is cylindrical in shape.

19. The system of claim 12 wherein the cap is further defined by a probe-port.

20. A method for placing sealant around a wire connection comprising the steps of:
- obtaining a conductive connector for splicing two or more wires featuring a head:
- obtaining a cap comprising;
  - a hollow body;
  - a first socket, located on the inside of the hollow body;
  - a second socket, located on the outside of the hollow body;
  - wherein the head is configured for removable input to the second socket so that the connector is releasably secured to the outside of the hollow body of the cap whenever the head is input into the second socket;
  - wherein the head is configured for removable input to the first socket so that the connector is securable to the inside of the hollow body of the cap whenever the head is input into the first socket; and
  - wherein said sockets are configured to receive and releasably retain the head of the connector;
- filling the cap with a sealant;
- securing the head of the connector to the second socket of the sealant filled cap;
- anchoring the wires to said connector;
- unsecuring the connector and wires from the second socket of the cap; and
- depositing the connector plus wires into the cap.

* * * * *